US010479105B2

(12) United States Patent
Hosokawa et al.

(10) Patent No.: US 10,479,105 B2
(45) Date of Patent: Nov. 19, 2019

(54) DROPLET DISCHARGE APPARATUS AND DROPLET DISCHARGE METHOD

(71) Applicant: RICOH COMPANY, LTD., Tokyo (JP)

(72) Inventors: Toshiaki Hosokawa, Shiga (JP); Jun Watanabe, Tokyo (JP); Tetsuyoshi Nakata, Kanagawa (JP); Yasunari Harada, Kanagawa (JP); Hideaki Iijima, Kanagawa (JP); Shunsuke Shitaoka, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 16/103,502

(22) Filed: Aug. 14, 2018

(65) Prior Publication Data

US 2019/0105920 A1 Apr. 11, 2019

(30) Foreign Application Priority Data

Oct. 5, 2017 (JP) ..... 2017-195410

(51) Int. Cl.

| | |
|---|---|
| ***B41J 2/21*** | (2006.01) |
| ***B41J 3/36*** | (2006.01) |
| *B41J 2/02* | (2006.01) |

(52) U.S. Cl.

CPC ..... *B41J 2/2135* (2013.01); *B41J 2/2132* (2013.01); *B41J 3/36* (2013.01); *B41J 2002/022* (2013.01)

(58) Field of Classification Search

CPC . B41J 2/2135; B41J 2/2132; B41J 3/36; B41J 2002/022

See application file for complete search history.

(56) References Cited

U.S. PATENT DOCUMENTS

2011/0109678 A1* 5/2011 Schwartz ..... B41J 3/36 347/14

2016/0082719 A1 3/2016 Harada et al.

FOREIGN PATENT DOCUMENTS

JP 2016-060103 4/2016

* cited by examiner

*Primary Examiner* — Yaovi M Ameh

(74) *Attorney, Agent, or Firm* — Xsensus LLP

(57) ABSTRACT

A droplet discharge apparatus to discharge droplets while moved by a user includes a head to discharge a droplet onto a recording medium, a sensor to detect a movement amount of the droplet discharge apparatus in a predetermined period, and a memory to store determination information indicating whether droplet discharging has been instructed for each pixel of the image data. The droplet discharge apparatus further includes a processor configured to accumulate the movement amount to calculate a total movement amount of the droplet discharge apparatus; instruct droplet discharging from the head based on the total movement amount and the image data; instruct droplet discharging only for an unprinted pixel for which the determination information indicates that droplet discharging has not been instructed; and rewrite the determination information of the unprinted pixel to indicate that droplet discharging has been instructed, based on a predetermined condition.

17 Claims, 11 Drawing Sheets

FIG. 7

T1

| Block No. | enable | TTL | dirty | Addr | Data |
|---|---|---|---|---|---|
| 0 | ON | 2 | ON | 0xA0A0B000 | (PIXEL DATA IN BLOCK) |
| 1 | OFF | 3 | OFF | 0xA0A0B100 | (PIXEL DATA IN BLOCK) |
| 2 | : | : | : | : | : |
| ⋮ | | | | | |
| 31 | : | : | : | : | : |

DROPLET DISCHARGE APPARATUS AND DROPLET DISCHARGE METHOD

CROSS-REFERENCE TO RELATED APPLICATIONS

This patent application is based on and claims priority pursuant to 35 U.S.C. § 119(a) to Japanese Patent Application No. 2017-195410, filed on Oct. 5, 2017, in the Japan Patent Office, the entire disclosure of which is hereby incorporated by reference herein.

BACKGROUND

Technical Field

The present disclosure relates to a droplet discharge apparatus and a droplet discharge method.

Description of the Related Art

In recent years, as laptop computers (e.g., personal computers) become compact and smart devices have been rapidly spread, compactness and portability of printers are strongly desired. In such a trend, already known are "handheld printers", in which a sheet conveyance mechanism is omitted. While a user moves the handheld printer to scan a sheet with a hand, ink is applied onto the sheet.

On a bottom face of the handheld printer, a sensor is disposed to detect a nozzle position during scanning. In the case of printing by the handheld printer moved freely, the sensor and a nozzle to discharge ink should be located above a recording medium.

SUMMARY

An embodiment of this disclosure provides a droplet discharge apparatus to discharge a droplet onto a recording medium according to image data while being moved by a user. The droplet discharge apparatus includes a head to discharge a droplet onto a recording medium, a sensor to detect a movement amount of the droplet discharge apparatus in a predetermined period, and a memory to store determination information indicating whether droplet discharging has been instructed for each pixel of the image data. The droplet discharge apparatus further includes a processor configured to accumulate the movement amount to calculate a total movement amount of the droplet discharge apparatus; instruct droplet discharging from the head based on the total movement amount and the image data; instruct droplet discharging only for an unprinted pixel for which the determination information indicates that droplet discharging has not been instructed; and rewrite the determination information of the unprinted pixel to indicate that droplet discharging has been instructed, based on a predetermined condition.

Another embodiment provides a droplet discharge method executed by a droplet discharge apparatus to form an image on a recording medium while being moved by a user. The method includes discharging a droplet onto the recording medium; detecting a movement amount of the droplet discharge apparatus in a predetermined period; accumulating the movement amount to calculate a total movement amount of the droplet discharge apparatus; instructing droplet discharging based on the total movement amount and image data; storing determination information indicating whether droplet discharging has been instructed for each pixel of the image data; instructing droplet discharging only for an unprinted pixel indicated for which the determination information indicates that droplet discharging has not been instructed; and rewriting the determination information of the unprinted pixel to indicate that droplet discharging has been instructed, based on a predetermined condition.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein:

FIG. 7 illustrates an example table managed by a table management and data processing unit of the handheld printer illustrated in FIG. 4;

Figure 1:
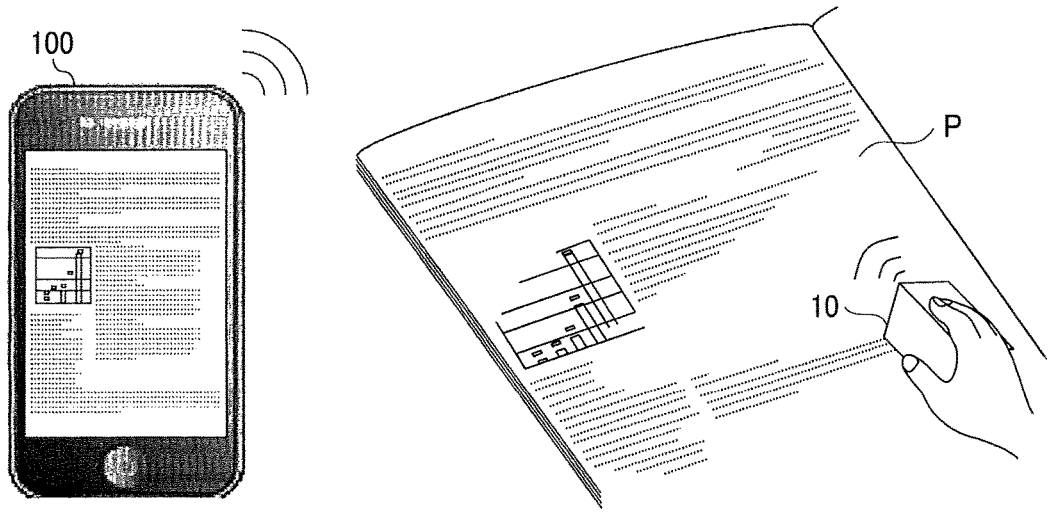
FIG. 1 is a diagram illustrating an example of printing using a handheld printer according to embodiment of the present disclosure.

The accompanying drawings are intended to depict embodiments of the present invention and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Referring now to the drawings, wherein like reference numerals designate identical or corresponding parts throughout the several views thereof, a droplet discharge apparatus according to an embodiment of this disclosure is described. As used herein, the singular forms "a", "an", and "the" are intended to include the plural forms as well, unless the context clearly indicates otherwise.

FIG. 1 is a diagram illustrating an example of printing using a handheld printer 10 (a droplet discharge apparatus) according to embodiment of the present disclosure. The handheld printer 10 receives image data from, for example, an image data output device 100 such as a smart device or a personal computer (PC). Subsequently, as a user freely moves the handheld printer 10 two-dimensionally on a recording media P (freehand scanning), the handheld printer 10 can form an image according to the image data. The recording medium P is, for example, a sheet of a notebook or a regular size paper sheet.

As will be described later, the handheld printer 10 includes a navigation sensor 18 and a gyro sensor 17 to detect a position. The handheld printer 10 is configured to discharge ink of the color to be applied to a target discharge position when the handheld printer 10 reaches the target discharge position. The position to which the ink has already been applied is masked and becomes not an object of ink discharge. Accordingly, the user can move the handheld printer 10 freely with a hand in any direction on the recording medium P to form an image.

Figure 2:
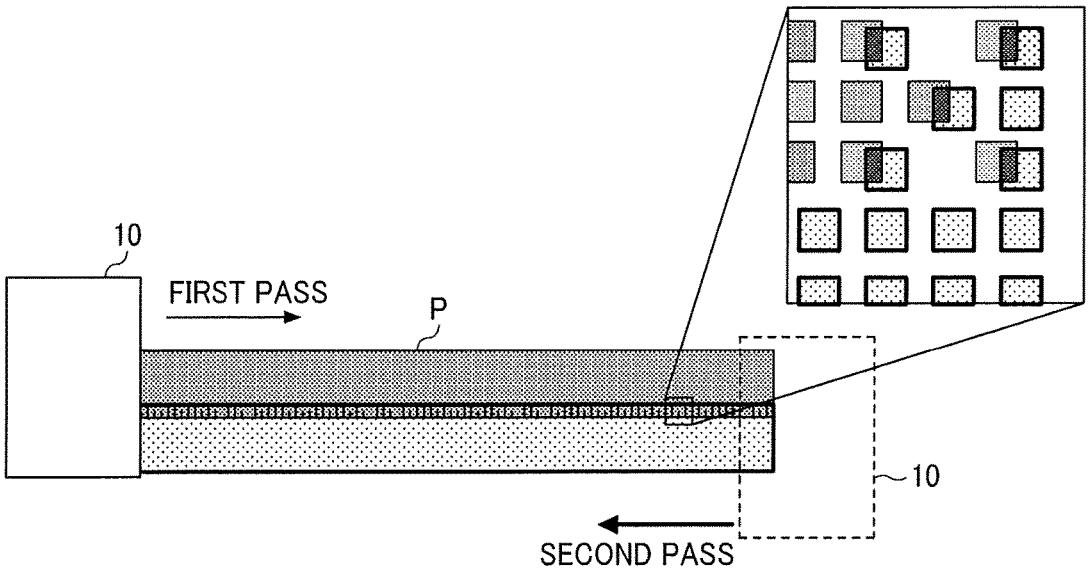
FIG. 2 is a diagram illustrating an example of positional deviation of printing by multiple passes.

FIG. 2 is a plan view illustrating an example of positional deviation in multi-pass printing. FIG. 2 is on an assumption that there is image data failed to be printed at position coordinates passed by the handheld printer 10 in a first pass.

There may be a slight error in position detection by handheld printers. When the nozzle passes again a target discharge position to which a droplet has not been applied, a droplet may be applied to a position slightly deviated from the target discharge position. Specifically, if a second pass overlaps the first pass, pixels drawn by ink discharged in the second pass overlap pixels drawn by ink discharged in the first pass in a misalignment manner, resulting in unintended shading.

By contrast, according to an aspect of the present disclosure described below, in the freehand scanning of the handheld printer, degradation of print quality caused by scanning of the same position on the recording medium P multiple times can be inhibited.

Figure 3:
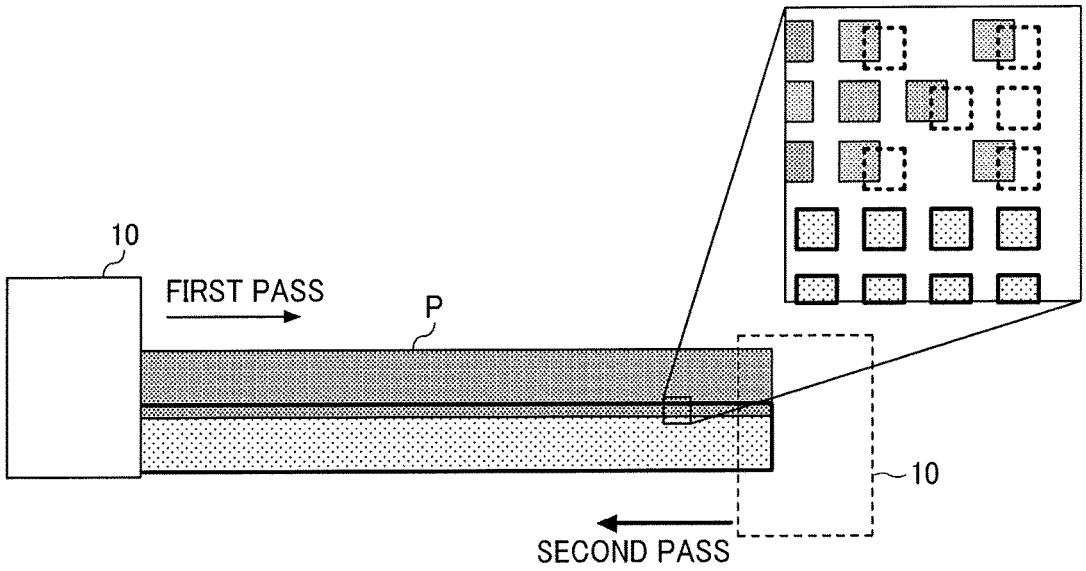
FIG. 3 is a plan view illustrating multi-pass printing according an embodiment.

FIG. 3 is a plan view illustrating an example of multi-pass printing according the present embodiment. As illustrated in FIG. 3, the handheld printer 10 does not discharge ink when passing by a position specified by position coordinates that corresponds to the image data and has been already passed by the handheld printer 10. Regarding image data that is not printed in a previous pass, the handheld printer 10 is configured not to discharge ink at the position coordinates that have been passed, in a subsequent pass. Accordingly, the handheld printer 10 can prevent image degradation caused by overlapping of misaligned ink at the position to which the ink has been already applied.

Figure 4:
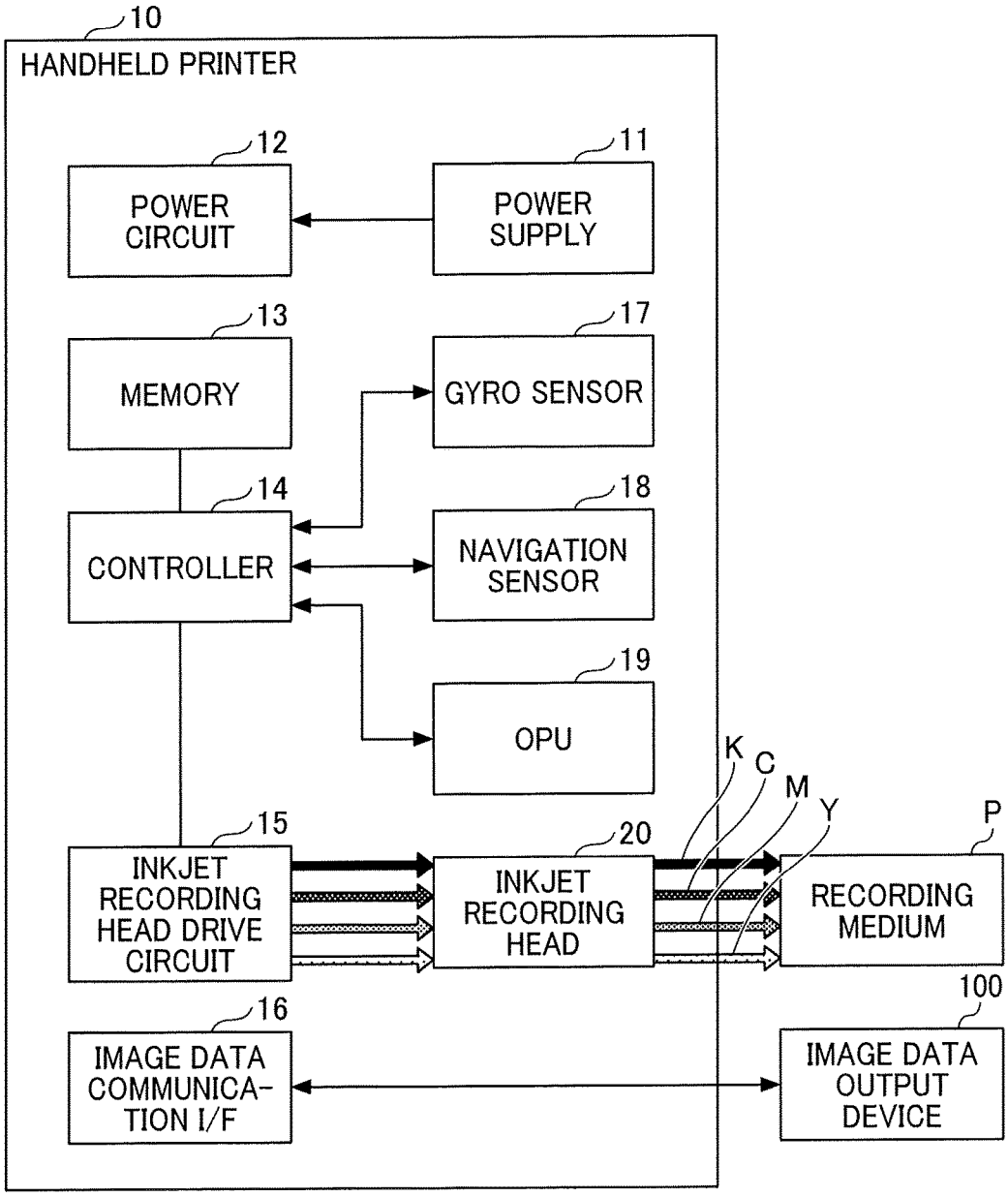
FIG. 4 is a block diagram illustrating a hardware structure of a handheld printer according to an embodiment.

FIG. 4 is a block diagram illustrating a hardware structure of the handheld printer 10 according to the present embodiment. The handheld printer 10 is an example of an image forming apparatus that forms an image on a recording medium. The handheld printer 10 includes a power supply 11, a power circuit 12, a memory 13, a controller 14, an inkjet recording head drive circuit 15, an image data communication interface (I/F) 16, the gyro sensor 17, the navigation sensor 18, an operation panel unit (OPU) 19, and an inkjet recording head 20.

As the power supply 11, a battery is mainly used. A solar battery, an alternating-current (AC) commercial power supply, a fuel cell, or the like may be used. The power circuit 12 distributes the power supplied by the power supply 11 to each part of the handheld printer 10. Further, the power circuit 12 steps down or up the voltage of the power supply 11 to a voltage suitable for each part. When the power supply 11 is a rechargeable battery, the power circuit 12 detects the connection of, for example, an AC power supply and connects the AC power supply to a charging circuit of the battery to charge the power supply 11.

The memory 13 includes a read only memory (ROM) to store firmware for hardware control of the handheld printer 10, drive waveform data for the inkjet recording head 20, and other data necessary for initial setting of the handheld printer 10. The ROM can be any one or a combination of a mask ROM, a programmable ROM (PROM), an electrically erasable PROM (EEPROM), a flash memory, a memory card that is an external storage medium, and the like; or a combination of two or more of such memory devices.

Further, the memory 13 includes a random access memory (RAM). The controller 14 uses the RAM as a work memory when executing the firmware. The RAM stores the image data received by the image data communication I/F 16 and is used to execute the expanded firmware. The RAM can be any one or a combination of two or more of a dynamic RAM (DRAM), a static RAM (SRAM), a synchronous DRAM (SDRAM), and the like.

The controller 14 includes a wired logic circuit included in a central processing unit (CPU) 101, an application specific integrated circuit (ASIC), a field-programmable gate array (FPGA), and the like and controls the entire handheld printer 10. For example, the controller 14 determines the position of each nozzle of the inkjet recording head 20 based on the movement amount detected by the navigation sensor 18 and the angular speed detected by the gyro sensor 17 so that the ink is discharged according to the position, thereby forming an image. The controller 14 is described in further detail later.

The inkjet recording head drive circuit 15 generates a drive waveform for driving the inkjet recording head 20 using the drive waveform data supplied from the controller 14. The inkjet recording head drive circuit 15 can generate a drive waveform corresponding to the size of ink droplet and the like.

The image data communication I/F 16 receives image data from the image data output device 100 (or an image input device) such as a personal computer (PC, also referred to as a client computer) or a smart device. The image data communication I/F 16 supports communication standards such as wireless local area network (LAN), Bluetooth (registered trademark), near field communication (NFC), infrared communication, and third generation (3G) or long term evolution (LTE), which are communication schemes for mobile phones. In addition to such wireless communication, the image data communication I/F 16 can be a communication device compatible with wired communication employing a wired LAN, a universal serial bus (USB) cable, or the like.

The gyro sensor 17 is a sensor to detect the angular speed of the handheld printer 10 when the handheld printer 10 rotates around an axis perpendicular to the recording medium P.

The navigation sensor 18 is a sensor to detect the amount of movement of the handheld printer 10 in each cycle time (predetermined period), for example, stored in a memory and predetermined by a manufacturer based on empirical data. The navigation sensor 18 includes, for example, a light source, such as a light emitting diode (LED) or a semiconductor laser, and an image sensor to capture an image of the recording medium P. As the user moves the handheld printer 10 on or over the recording medium P, the navigation sensor 18 sequentially captures or detects minute edges of the recording medium P. The navigation sensor 18 analyzes the distance between the edges to obtain the travel distance (movement amount) of the handheld printer 10. In the present embodiment, the navigation sensor 18 can be mounted on the bottom face of the handheld printer 10 to calculate the movement amount, and the angular speed can be calculated by the gyro sensor 17. A multi-axis acceleration sensor can be used as the navigation sensor 18, and the handheld printer 10 can detect the movement amount based on the detection by the acceleration sensor.

The OPU 19 includes an LED to indicate a status of the handheld printer 10, a liquid crystal display, a touch panel for the user to instruct the handheld printer 10 to form an image, and the like. The OPU 19 can further have a voice input function.

The inkjet recording head 20 is a head to discharge ink (droplets) and includes a plurality of nozzles. In FIG. 4, the inkjet recording head 20 is configured to discharge inks of four colors, namely, cyan (C), magenta (M), yellow (Y), and black (B). Alternatively, the inkjet recording head 20 can be configured to discharge single color ink or five or more different color inks. The inkjet recording head 20 includes a plurality of ink discharge nozzles arranged in one row or a plurality of rows for each color. The ink discharge method can be, for example, a piezo method or a thermal method but not limited thereto.

Figure 5:
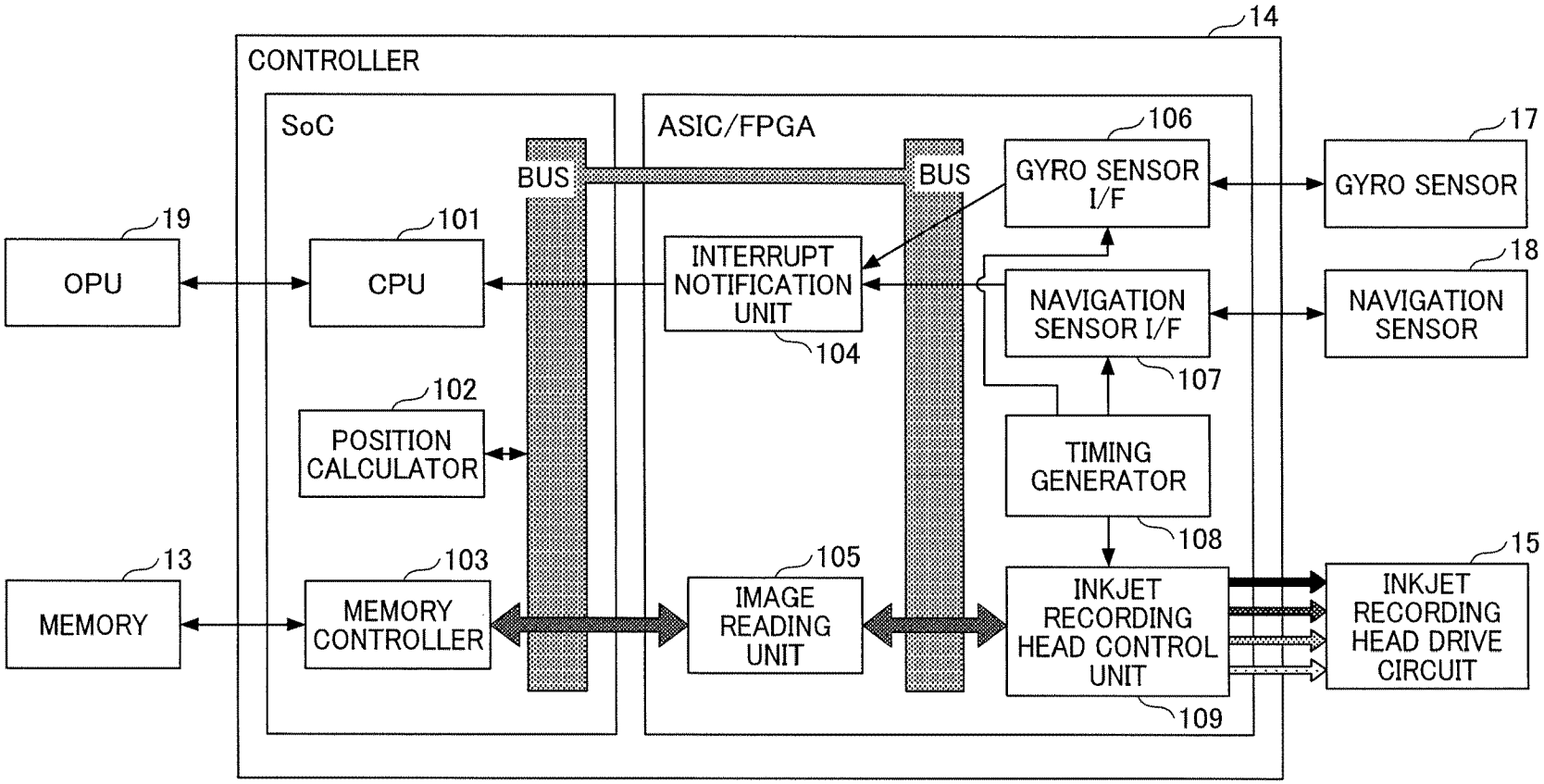
FIG. 5 is a functional block diagram of a controller of the handheld printer illustrated in FIG. 4.

FIG. 5 is a functional block diagram of the controller 14 (a processor) according to the present embodiment. As illustrated in FIG. 5, the controller 14 includes the CPU 101, a position calculator 102, a memory controller 103, an interrupt notification unit 104, an image reading unit 105, a gyro sensor I/F 106, a navigation sensor I/F 107, a timing generator 108, and an inkjet recording head control unit 109. For example, as illustrated in FIG. 5, the hardware of the controller 14 can be implemented by a system on chip (SoC) and an application specific integrated circuit/field-programmable gate array (ASIC/FPGA) that communicate with each other via a bus. The ASIC/FPGA represents that the hardware can be designed to be implemented by either of ASIC and FPGA, and the hardware can be implemented by other technology than ASIC/FPGA. Further, the controller 14 can be implemented by one chip or board without using separate chips (or separate boards) respectively mounting the SoC and the ASIC/FPGA. Alternatively, the controller 14 can be implemented by three or more chips or boards. Further, each functional unit of the controller 14 can be implemented by the firmware executed by the CPU 101 or a wired logic circuit included in the SoC or the ASIC/FPGA.

The CPU 101 is a functional unit that reads and executes the firmware loaded in the memory 13 via the memory controller 103, to implement each functional unit of the controller 14.

The position calculator 102 calculates the position of the handheld printer 10, based on the movement amount detected for each sampling cycle (predetermined period) of the navigation sensor 18 and the angular speed (movement amount) detected for each sampling cycle (predetermined period) of the gyro sensor 17. The position of the handheld printer 10 necessary for accurate printing is, strictly speaking, positions of nozzles. The position of the nozzle can be calculated when the position of the navigation sensor 18 is known. Further, the position calculator 102 calculates the target discharge position of ink. The position calculator 102 can be implemented by the CPU 101 executing the firmware or a wired logic circuit. The position of the handheld printer 10 mentioned here is equivalent to a total movement amount obtained as an accumulation of the movement amount detected for each sampling cycle of the navigation sensor 18 and the angular speed detected for each sampling cycle of the gyro sensor 17.

The memory controller 103 controls reading from or writing to the memory 13 from each functional unit.

The interrupt notification unit 104 detects completion of communication of the navigation sensor IN 107 with the navigation sensor 18 and outputs an interrupt signal for reporting the completion to the CPU 101. For example, with the interruption, the CPU 101 acquires the movement amount of the navigation sensor 18 stored in an internal register by the navigation sensor I/F 107. The interrupt notification unit 104 further has a function to report a status such as an error. Similarly, regarding the gyro sensor I/F 106, the interrupt notification unit 104 outputs an interrupt signal for notifying the CPU 101 of completion of communication of the gyro sensor I/F 106 with the gyro sensor 17.

The image reading unit 105 calculates the position of each nozzle of the inkjet recording head 20 based on the position information of the navigation sensor 18, retrieves the image data corresponding to the nozzle position from the memory 13, and outputs the image data in the order requested by the inkjet recording head control unit 109.

The gyro sensor I/F 106 acquires the angular speed detected by the gyro sensor 17 at the timing generated by the timing generator 108 and stores the angular speed in the memory 13 or a register inside the controller 14.

The navigation sensor I/F 107 communicates with the navigation sensor 18 at the timing generated by the timing generator 108, receives the movement amount as information from the navigation sensor 18, and stores the movement amount in the memory 13 or the register inside the controller 14.

The timing generator 108 notifies the navigation sensor I/F 107 and the gyro sensor I/F 106 of the timings to read information from the gyro sensor 17 and the navigation sensor 18, respectively, and notifies the inkjet recording head control unit 109 of the drive timing.

The inkjet recording head control unit 109 performs dithering or the like of the image data to convert the image data into a set of points representing the image with point size and density. Through such conversion, the image data becomes data of discharge positions and point sizes. The inkjet recording head control unit 109 outputs a control signal corresponding to the point size to the inkjet recording head drive circuit 15. The inkjet recording head drive circuit 15 generates a drive waveform using the drive waveform data corresponding to the control signal.

In addition, the inkjet recording head control unit 109 determines whether to discharge ink in accordance with the position of the nozzle. The inkjet recording head control unit 109 determines to discharge ink when there is a target discharge position or determines not to discharge ink when there is no target discharge position. The inkjet recording head control unit 109 outputs a pixel regarding which ink discharge has been performed to the image reading unit 105.

Figure 6:
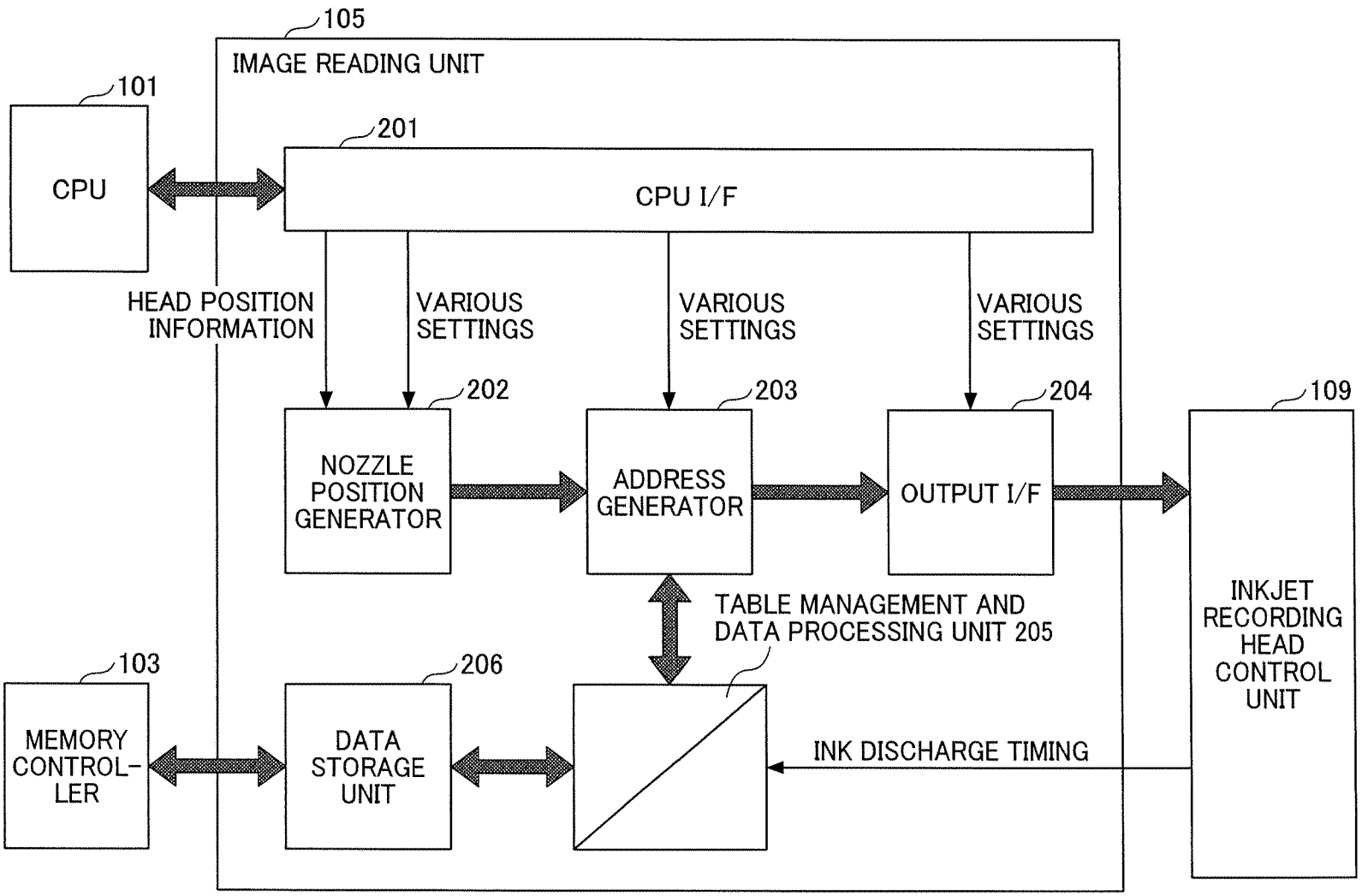
FIG. 6 is a functional block diagram illustrating an example configuration of an image reading unit of the handheld printer illustrated in FIG. 4.

FIG. 6 is a functional block diagram illustrating an example configuration of the image reading unit 105 according to the present embodiment. The image reading unit 105 includes a CPU I/F 201, a nozzle position generator 202, an address generator 203, an output I/F 204, a table management and data processing unit 205, and a data storage unit 206.

The CPU I/F 201 acquires, from the CPU 101, various settings such as the width, the height, and the resolution of the image and applies the settings to the nozzle position generator 202, the address generator 203, or the output I/F 204. Further, the CPU I/F 201 acquires position information of the inkjet recording head 20 (head position information) at the corresponding timing, for each ink discharge timing, from the inkjet recording head control unit 109.

The nozzle position generator 202 generates position information of each nozzle based on the head position information. Each time the nozzle position generator 202 receives the head position information, the nozzle position generator 202 generates position information for the number corresponding to the number of nozzles and outputs the position information to the address generator 203. In addition, the nozzle position generator 202 outputs a flag indicating that the nozzle is valid or invalid for each nozzle, to the address generator 203, and controls, for example, print mode and the number of discharge nozzles (limits the number of discharge nozzles).

Further, to reduce the load on the CPU 101, preferably, the head position information supplied from the CPU 101 is minimum data such as coordinates of both ends of the inkjet recording head 20.

Based on the position information of each nozzle acquired from the nozzle position generator 202, the address generator 203 generates a memory address indicating the storage location of the corresponding image data.

The output I/F 204 converts the format of the image data read out from the memory 13 into a format requested by the inkjet recording head control unit 109. Further, the output I/F 204 buffers the data as necessary.

The table management and data processing unit 205 associates the address generated by the address generator 203 with the data stored in the data storage unit 206. When the values of the data are different between the memory 13 and the data storage unit 206, the table management and data processing unit 205 processes the data and outputs the processed data to the data storage unit 206 as write data.

The data storage unit 206 accumulates the data read from the memory 13 via the memory controller 103. Further, the data storage unit 206 temporarily accumulates the write data to be written in the memory 13. The write data includes information on whether or not discharging has completed for each pixel, acquired from the inkjet recording head control unit 109.

FIG. 7 illustrates an example table managed by the table management and data processing unit 205 in the present embodiment. The table management and data processing unit 205 manages the information presented in Table T1 illustrated in FIG. 7. In Table T1, the number of blocks (into which the image data is divided) is 32. One block corresponds the unit of scanning of the inkjet recording head 20 and includes a plurality of pixels.

The column "enable" indicates whether the corresponding block is valid (ON) or invalid (OFF). The column "TTL (Time To Live)" indicates the lifetime of the corresponding block. For example, the lifetime can be defined as one cycle of reading from or writing in the memory. The column "dirty" is a flag indicating that values are different between the memory 13 and the data storage unit 206. A flag is set when write data regarding the block is generated. The column "Addr" indicates an address on the memory 13 where data corresponding to that block of data is stored. In the column "Data", a copy of the data stored in the memory 13 is stored. When the "dirty" flag is set, the table management and data processing unit 205 determines that the corresponding position has been passed by the inkjet recording head 20 and processes the "Data".

Figure 8B:
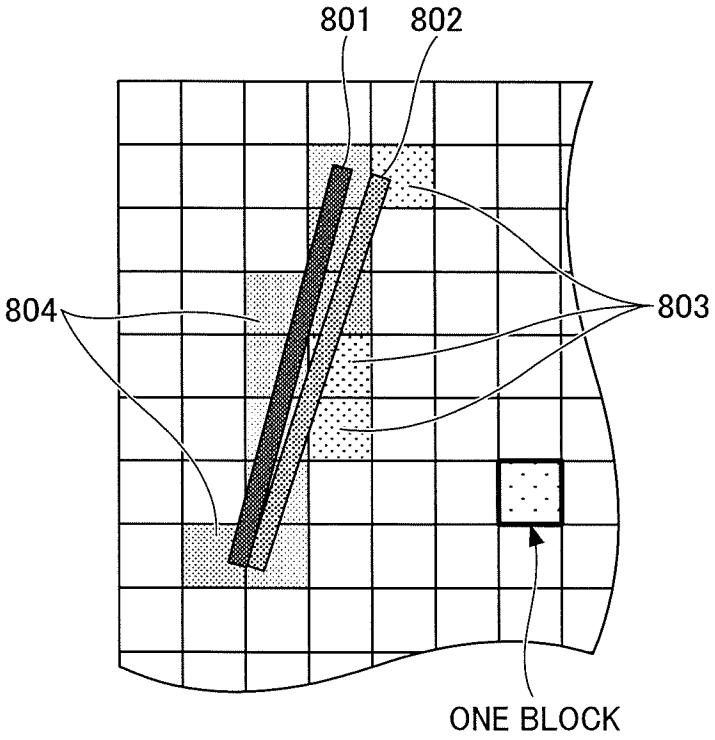
FIGS. 8A and 8B are diagrams illustrating the amount of memory access required by the movement of a head of the handheld printer illustrated in FIG. 4.
Figure 8A:
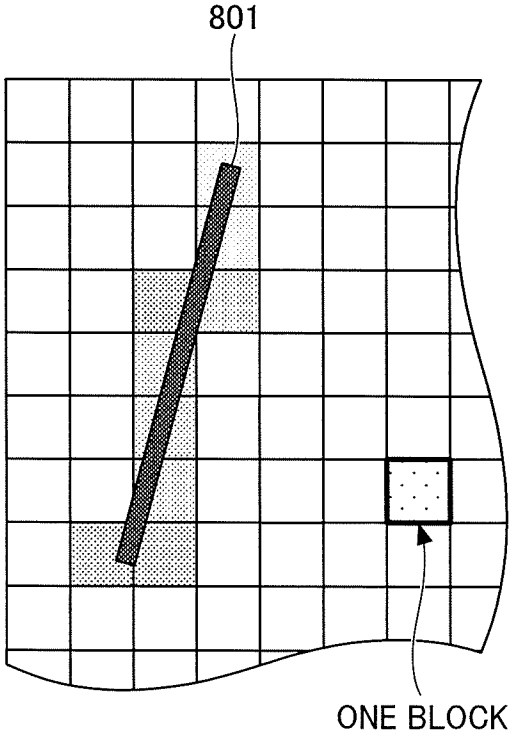

FIGS. 8A and 8B are diagrams illustrating the amount of access to the memory 13 required by the movement of the inkjet recording head 20 in the present embodiment. FIG. 8A illustrates a position 801 of the inkjet recording head 20 at Nth discharging and the blocks for which the data is to be read from the memory 13 at that time. When the inkjet recording head 20 is at the position 801, blocks lightly shaded are to be accessed. FIG. 8B additionally illustrates a position 802 at which the inkjet recording head 20 is located at (N+1)th discharging subsequent to Nth discharging, and blocks to be additionally read from the memory 13 are hatched.

It is assumed that the inkjet recording head 20 moves from the position 801 to the position 802 in the (N+1)th discharging. At that time, only blocks 803 are to be additionally read. When the memory data read one cycle before is stored inside the image reading unit 105, the number of times of access to the memory 13 can be reduced. The capacity necessary for the data storage unit 206 (an internal memory of the image reading unit 105), is calculated as "a maximum number of blocks accessed in one discharging plus a maximum number of blocks to be additionally accessed in the subsequent discharging".

In FIG. 8B, the data of blocks 804 are not used in the (N+1)th discharging. Accordingly, discarding or written back the corresponding data to the memory 13 is advantageous in that the corresponding portion of the data storage unit 206 can be released.

Figure 9:
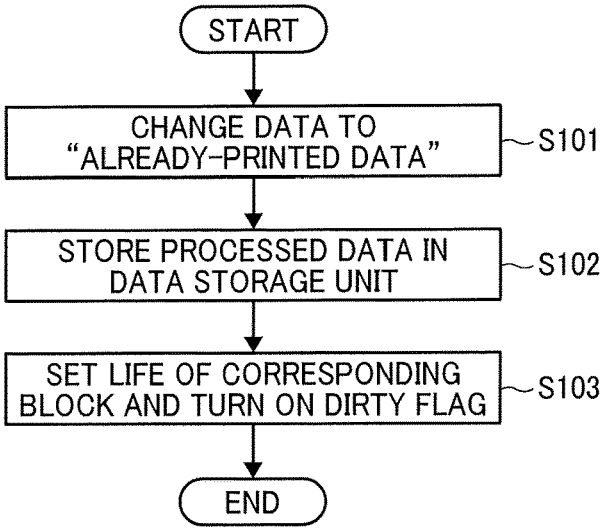
FIG. 9 is a flowchart illustrating operation of writing in a memory (memory writing) according to an embodiment.

FIG. 9 is a flowchart illustrating data writing in the memory 13 according to the present embodiment. In the present embodiment, when the data once read is processed and written back to the same address, a write access arises. Inevitably, the same address has been read immediately before the writing back. Therefore, a write access arises at the block regarding which ink has been discharged according to the data read. Such a write access process is executed for each block.

The process illustrated in FIG. 9 starts at the occurrence of write request controlled by the memory controller 103. When a request of writing in the memory 13 occurs, at S101, the table management and data processing unit 205 changes (processes) the data of the block regarding which the ink has been discharged to "already-printed data". At S102, the table management and data processing unit 205 stores the processed data (already-printed data) processed at S101 in the data storage unit 206.

At S103, the table management and data processing unit 205 sets the life (TTL) of that block in Table T1 and turns the dirty flag "ON".

The column "TTL" represents the lifetime (time to live) of the corresponding block and is set, for example, as follows. The data of the block is written back to the memory 13 in a case where a write access regarding that block does not occur in two or more cycles after the write occurs, and the data of the block is discarded in a case where no access arises in further two cycles.

The inkjet recording head control unit 109 controls the inkjet recording head 20 not to discharge ink regarding the blocks processed to the already-printed data. In order to prevent, for each target discharge position (per pixel), discharging again ink at the position to which ink is not fully applied, the above processing is performed per target discharge position (per pixel) instead of per block.

Figure 10:
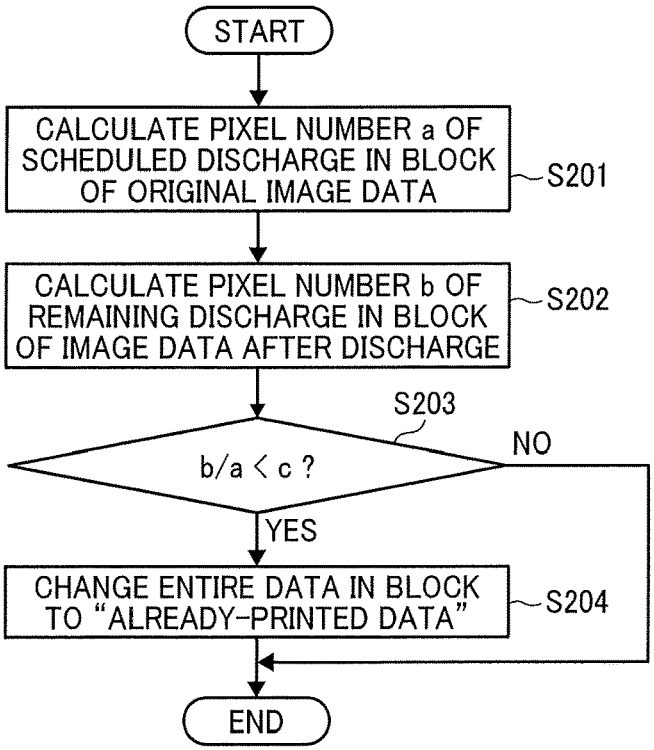
FIG. 10 is a flowchart illustrating data processing method according Example 1 of the present disclosure.

FIG. 10 is a flowchart illustrating data processing method according to Example 1 of the present disclosure. In FIG. 10, the term "original image data" is image data according to which printing is not yet performed, and the processing in FIG. 10 is executed for each block.

At S201, the table management and data processing unit 205 calculates a pixel number a, which is the number of pixels (total number of pixels) regarding which discharge is scheduled in the block (the predetermined region) of the original image data. Subsequently, after ink discharging, the table management and data processing unit 205 calculates a remaining pixel number b, which is the number of unprinted pixels regarding which ink has not yet discharged in the block.

From the pixel number a obtained at S201 and the remaining pixel number b obtained at S202, at S203, the table management and data processing unit 205 determines whether or not the ratio of the remaining pixel number b relative to the pixel number a (b/a) is smaller than a threshold c (b/a<c). The threshold c is a predetermined condition and arbitrarily set. Since the table management and data processing unit 205 determines whether to keep the data of that block based on the threshold c, the value of the threshold c is preferably determined based on sufficient evaluation.

With the determination at S203, the table management and data processing unit 205 prevents data of the block according to which ink is mostly undischarged from being changed to the already-printed data.

In response to a determination "Yes" at S203, the table management and data processing unit 205 determines that an already printed portion is large and an unprinted portion is small in the block, processes the entire data in the block as the already-printed data, and stores the already-printed data in the data storage unit 206 (S204).

In response to a determination "No" at S203, the table management and data processing unit 205 determines that the already printed portion is small in the block and stores, as is, the image data after ink discharging in the data storage unit 206.

Figure 11A:
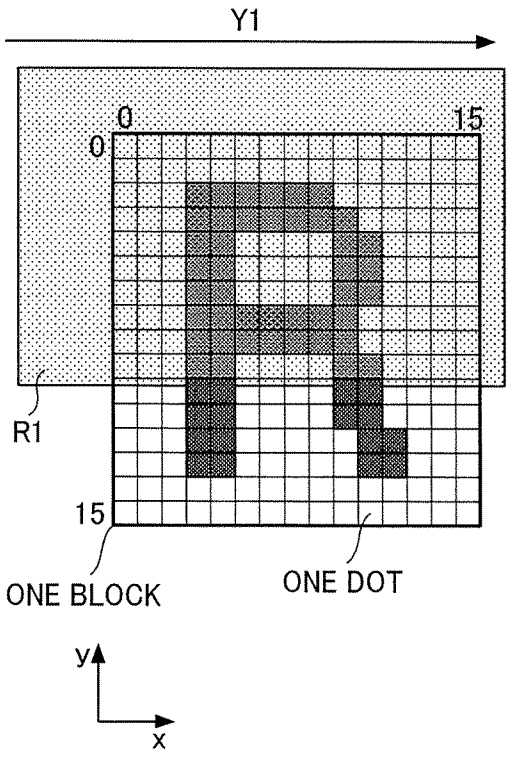
FIGS. 11A, 11B, and 11C are diagrams illustrating remaining image data (unprinted image data) within one block by scanning of an inkjet recording head according to an embodiment.
Figure 11B:
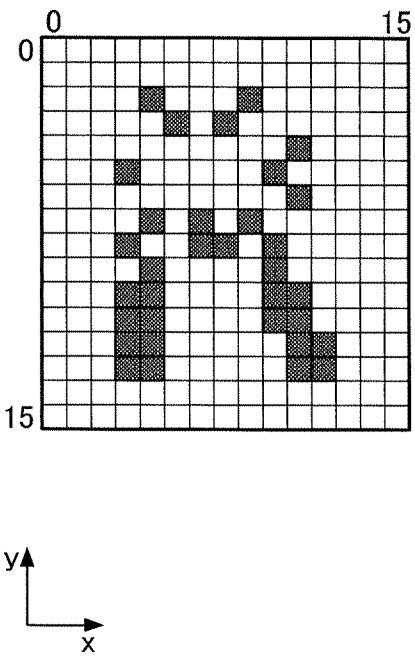
Figure 11C:
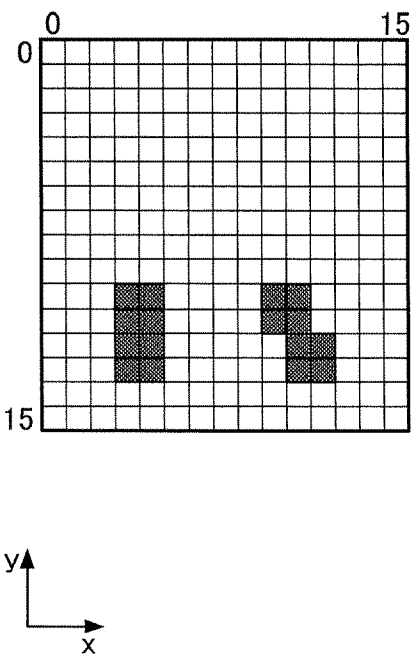

FIGS. 11A, 11B, and 11C are diagrams illustrating remaining image data within one block of scanning by the inkjet recording head 20 according to the present embodiment. Each of FIGS. 11A to 11C illustrates one block of image data, and each square in the block represents one pixel (dot). In the example illustrated in FIGS. 11A to 11C, one block is a square including 16 pixels in each lateral row and each column (16×16 pixels).

The "remaining image data" arises when the image reading unit 105 determines not to discharge ink according to the image data to be printed (data of black in the case of monochrome printing) within the area passed by the inkjet recording head 20. The image reading unit 105 determines that ink is to be discharged to a pixel when the timing of the pixel matches the physical location of the image data, and determines that ink is not to be discharged to a pixel when the timing of the pixel does not match the physical location of the image data. When the scanning speed is high or the discharging cycle is slow relative to the physical location of the image data, the discharging timing does not match. Accordingly, the image reading unit 105 determines not to discharge ink, and thus "remaining image data" arises.

FIG. 11A illustrates one block of image data before printing. FIG. 11B illustrates an image of the remaining discharge after the inkjet recording head 20 moves in a range R1 illustrated in FIG. 11A in the direction indicated by arrow Y1 illustrated in FIG. 11A.

In the case of scanning in a direction x as illustrated in FIGS. 11A, as illustrated in FIG. 11B, the ratio of the remaining discharge differs between an upper portion and a lower portion in one block.

Therefore, the image data illustrated in FIG. 11A is compared with the image data illustrated in FIG. 11B for each row, so that only the remaining discharge corresponding to the scanning direction can be deleted as illustrated in FIG. 11C (details will be described later).

This example is on the assumption that the direction of scanning is the direction x. Alternatively, when the scanning is performed in a direction y, the above-described operation is performed for each column, thereby processing the data similar to the case where the scanning direction is the direction x.

Figure 12:
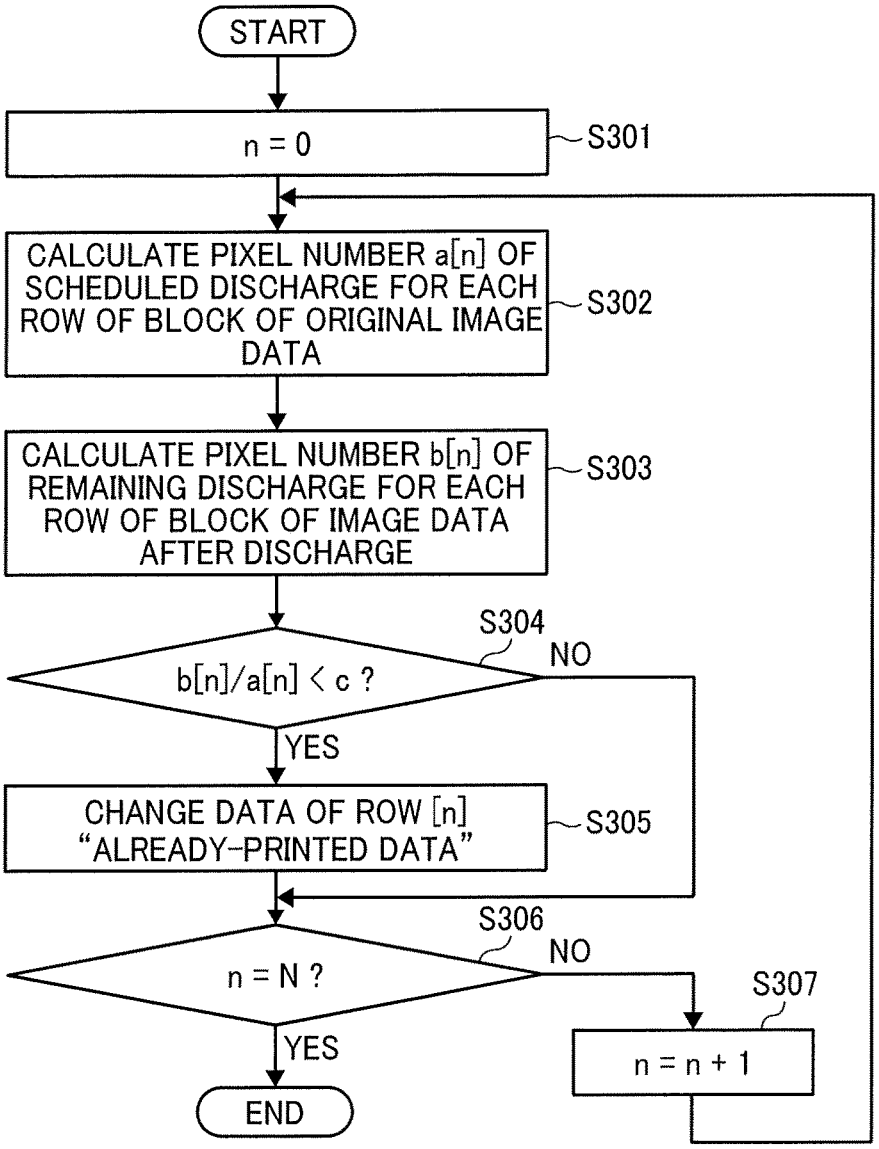
FIG. 12 is a flowchart illustrating data processing method according to Example 2 of the present disclosure.

FIG. 12 is a flowchart illustrating data processing method according to Example 2 of the present disclosure. The process illustrated in FIG. 12 is performed for each block, and the number of rows in one block is (N+1). For example, in the example illustrated in FIG. 11, N=15.

At S301, a variable n indicating the row number or column number (sequential number) in the block is set to 0. Hereinafter, "row" can be replaced with "column".

At S302, the table management and data processing unit 205 calculates the pixel number a of the nth row (a[n]), which is the number of pixels regarding to which ink is schemed to be discharged in the nth row of the original image data. Subsequently, the table management and data processing unit 205 calculates the pixel number b of the nth row (b[n]), which is the number of remaining pixels regarding which ink is not yet discharged in the same block for the nth row (S303).

Based on the pixel number a[n] obtained at S302 and the pixel number b[n] obtained at S303, at S305, the table management and data processing unit 205 determines whether the ratio of the pixel number b[n] to the pixel number a[n] is smaller than the threshold c (b[n]/a[n]<c). The threshold c is arbitrarily set. Similar to the flowchart illustrated in FIG. 10, the table management and data processing unit 205 determines whether to keep the data of that block based on the threshold c. Accordingly, the value of the threshold c is preferably determined based on sufficient evaluation.

With the determination at S304, the table management and data processing unit 205 prevents data of the row according to which ink is mostly undischarged from being changed to the already-printed data.

In response to a determination "Yes" at S304, the table management and data processing unit 205 determines that the already printed portion is large and the unprinted portion is small in the nth row, processes the entire data in the nth row as the already-printed data, and stores the already-printed data in the data storage unit 206 (S305). Then, the operation proceeds to S306.

In response to a determination "No" at S304, the table management and data processing unit 205 determines that the already printed portion is small in the nth row and stores, as is, the image data after ink discharging in the data storage unit 206. Then, the operation proceeds to S306.

At S306, the table management and data processing unit 205 determines whether or not the number n is equal to N (n=N), that is, whether or not the current row is the last row. In response to a determination that the number n is not equal to N (No at S306), at S307, the variable n is incremented (n=n+1), that is, the process proceeds to the next row. Then, the operation returns to S302. In response to a determination that the number n is equal to N (Yes at S306), the operation ends since the processing of all rows in the block has been completed.

Figure 13:
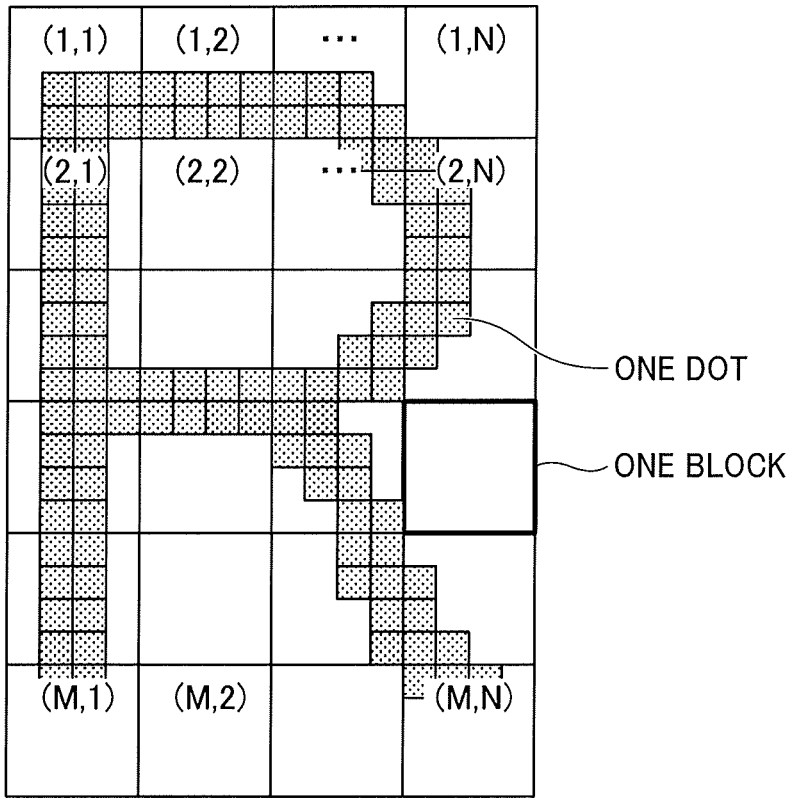
FIG. 13 is a diagram illustrating a memory arrangement of image data according to an embodiment of the present disclosure.

FIG. 13 is a diagram illustrating a memory arrangement of image data according to one embodiment. In the handheld printer 10 according to the present embodiment, as illustrated in FIG. 13, in order to improve the memory access efficiency, the memory arrangement is set in blocks in advance. In FIG. 13, the number of blocks in one row of image data is "N", and the number of blocks in one row is "M". The image data is stored in the memory 13, per block including a plurality of pixels arranged vertically and horizontally.

Storing the image data in the memory 13 in blocks is advantageous in that adjacent pieces of image data can be read in one access to the memory 13, thus improving the memory access efficiency. The block preferably has a shape close to a square and, for example, includes 16 pixels in each row and each column (16×16). For example, in a case of a laterally long block, although the efficiency is high when the inkjet recording head 20 is disposed landscape, the number of accesses increases and the efficiency is lowered when the inkjet recording head 20 is disposed portrait.

Further, preferably, the block size and the address of the head (start) of the image data is aligned so that one block of image data is read in one memory access, to improve the memory access efficiency.

As described above, according to the present embodiment, for each block, each pixel, or each row or column (i.e., one pixel line) of the block, the handheld printer 10 sets the image data corresponding to a once-scanned position to already-printed data and stores the already-printed data in the memory 13. Such setting can prevent discharging ink to that block, pixel, row, or column when an identical position is scanned second time or subsequent time. Therefore, in the freehand scanning of the handheld printer 10, degradation of print quality can be inhibited even when the handheld printer 10 scans the same position of the recording medium P multiple times.

In the present disclosure, the handheld printer 10 is an example of a droplet discharge apparatus. The inkjet recording head 20 is an example of a head. The navigation sensor 18 and the gyro sensor 17 are example sensors. The position calculator 102 is an example of a total movement amount calculator. The image reading unit 105 and the inkjet recording head control unit 109 together constitute a discharge control unit. The image reading unit 105 is an example of a processing unit. A square or laterally long block is an example of a rectangle.

Any one of the above-described operations may be performed in various other ways, for example, in an order different from the one described above.

The above-described embodiments are illustrative and do not limit the present invention. Thus, numerous additional modifications and variations are possible in light of the above teachings. For example, elements and/or features of different illustrative embodiments may be combined with each other and/or substituted for each other within the scope of the present invention.

What is claimed is:

1. A droplet discharge apparatus to discharge a droplet onto a recording medium according to image data while being moved by a user, the droplet discharge apparatus comprising:

a head to discharge the droplet onto the recording medium;

a sensor to detect a movement amount of the droplet discharge apparatus in a predetermined period;

a memory to store determination information, which indicates whether droplet discharging has been instructed for each pixel of the image data; and a processor configured to:

accumulate the movement amount to calculate a total movement amount of the droplet discharge apparatus;

instruct droplet discharging from the head based on the total movement amount and the image data, the instructed droplet discharging being only for an unprinted pixel for which the determination information indicates that droplet discharging has not been instructed and the unprinted pixel being included in a predetermined region of the image data;

calculate a ratio between a number of printed pixels in the predetermined region and a total number of pixels in the predetermined region, the printed pixels for which the determination information indicates that droplet discharging has been instructed; and rewrite, based on the ratio, the determination information of the unprinted pixel to indicate that droplet discharging has been instructed.

2. The droplet discharge apparatus according to claim 1, wherein the predetermined region is rectangular and includes a plurality of pixels.

3. The droplet discharge apparatus according to claim 1, wherein the predetermined region is one pixel line.

4. The droplet discharge apparatus according to claim 3, wherein the one pixel line corresponds to a scanning direction of the droplet discharge apparatus.

5. The drop discharge apparatus according to claim 1, wherein the processor is further configured to calculate the total number of pixels in the predetermined region, and calculate the number of printed pixels in the predetermined region.

6. The droplet discharge apparatus according to claim 1, wherein the processor is configured to divide the image data into a plurality of predetermined regions, the plurality of predetermined regions including the predetermined region.

7. The droplet discharge apparatus according to claim 6, wherein the memory is configured to store determination information for each predetermined region of the plurality of predetermined regions.

8. The drop discharge apparatus according to claim 7, wherein the processor is further configured to calculate, for each respective predetermined region of the plurality of predetermined regions, a respective ratio between a number of printed pixels in the respective predetermined region and a total number of pixels in the respective predetermined region, and rewrite, for each respective predetermined region of the plurality of predetermined regions and based on the respective ratio, the determination information of an unprinted pixel to indicate that droplet discharging has been instructed.

9. The drop discharge apparatus according to claim 1, wherein the processor rewrites the determination information in a case that the ratio is less than a predetermined threshold.

10. The drop discharge apparatus according to claim 1, wherein the processor does not rewrite the determination information in a case that the ratio is greater than a predetermined threshold.

11. A droplet discharge method executed by a droplet discharge apparatus to discharge a droplet onto a recording medium according to image data while being moved by a user, the method comprising:

discharging the droplet onto the recording medium;

detecting a movement amount of the droplet discharge apparatus in a predetermined period;

accumulating the movement amount to calculate a total movement amount of the droplet discharge apparatus;

storing determination information in a memory, the determination information indicating whether droplet discharging has been instructed for each pixel of the image data;

instructing droplet discharging based on the total movement amount and image data, the instructed droplet discharging being only for an unprinted pixel for which the determination information indicates that droplet discharging has not been instructed and the unprinted pixel being included in a predetermined region of the image data;

calculating a ratio between a number of printed pixels in the predetermined region and a total number of pixels in the predetermined region, the printed pixels for which the determination information indicates that droplet discharging has been instructed; and rewriting, based on the ratio, the determination information of the unprinted pixel to indicate that droplet discharging has been instructed.

12. The droplet discharge method according to claim 11, wherein the predetermined region is rectangular and includes a plurality of pixels.

13. The droplet discharge method according to claim 11, wherein the predetermined region is one pixel line that corresponds to a scanning direction of the droplet discharge apparatus.

14. The drop discharge method according to claim 11, further comprising:

calculating the total number of pixels in the predetermined region; and calculating the number of printed pixels in the predetermined region.

15. The droplet discharge method according to claim 11, further comprising:

dividing the image data into a plurality of predetermined regions, wherein the plurality of predetermined regions includes the predetermined region.

16. The droplet discharge method according to claim 15, further comprising:

storing, in the memory, determination information for each predetermined region of the plurality of predetermined regions.

17. The drop discharge method according to claim 16, further comprising:

calculating, for each respective predetermined region of the plurality of predetermined regions, a respective ratio between a number of printed pixels in the respective predetermined region and a total number of pixels in the respective predetermined region; and rewriting, for each respective predetermined region of the plurality of predetermined regions and based on the respective ratio, the determination information of an unprinted pixel to indicate that droplet discharging has been instructed.

* * * * *